United States Patent [19]

Ceccherini et al.

[11] Patent Number: 4,844,702

[45] Date of Patent: Jul. 4, 1989

[54] LUBRICATION CIRCUIT OF ROTARY VACUUM PUMPS

[75] Inventors: Massimo Ceccherini; Silvio Dondoli, both of Florence, Italy

[73] Assignee: Officine Galileo SpA, Italy

[21] Appl. No.: 151,468

[22] Filed: Feb. 2, 1988

[30] Foreign Application Priority Data

Feb. 4, 1987 [IT] Italy ..... 9321 A/87

[51] Int. Cl.[4] ..... F04B 49/02; F04C 27/02

[52] U.S. Cl. ..... 417/281; 417/295; 418/88; 418/96; 418/97

[58] Field of Search ..... 417/281, 295; 418/84, 418/88, 96, DIG. 1, 97, 99

[56] References Cited

U.S. PATENT DOCUMENTS

| | | | |
|---|---|---|---|
| 1,988,296 | 1/1935 | Blume et al. | 417/295 |
| 4,366,834 | 1/1983 | Hanson et al. | 417/295 |
| 4,483,667 | 11/1984 | Berges et al. | 417/281 |
| 4,525,129 | 6/1985 | Berges et al. | 417/281 |

FOREIGN PATENT DOCUMENTS

| | | | |
|---|---|---|---|
| 970900 | 9/1964 | United Kingdom | 418/96 |

*Primary Examiner*—John J. Vrablik

*Attorney, Agent, or Firm*—McGlew & Tuttle

[57] ABSTRACT

A lubrication circuit connected to rotary vacuum pumps is composed of a hydraulic circuit and of the relative pump unit for lubrication and for auxiliary controls, including isolation of the negative pressure space from the pump on the stopping of the latter, with the aid of a closure member (10), for the operation of which use is made of the pressure of the fluid present in the pump discharge space with the aid of a duct (33, 34) between said discharge space and a means (8, 9) operating the closure member (10), which duct is subdivided into two portions between which is disposed a control member (27, 31) the operation of which is dependent on the oil pressure produced by the pump unit and propagated, with complete absence of flow, through a duct (23) so as to reach a control member (27, 31) which supervises the operation of the closure member (10).

4 Claims, 3 Drawing Sheets

LUBRICATION CIRCUIT OF ROTARY VACUUM PUMPS

FIELD AND BACKGROUND OF THE INVENTION

The present invention relates to an improvement to a lubrication circuit of a vacuum pump, for the purpose of achieving numerous functions which the pump can perform by using the lubrication circuit; this is all achieved without constructional complications and with minimum additional cost.

In order to be able to reach high vacuum values, rotary pumps generally use oil as a dynamic seal for sealing coupling clearances. In order to enable the oil also to exert an indispensable lubrication action between parts moving relative to one another and to dissipate heat, it is necessary to ensure adequate circulation of the oil inside the pump.

In pumps at present on the market this circulation is achieved principally in two ways:

(a) through reduced pressure: the oil is drawn back into the vacuum pump by way of calibrated ducts through the difference in pressure between the outside and the inside;

(b) through forced circulation: the oil is driven into the interior of the vacuum pump by means of an auxiliary pump.

It is obvious that in the first solution, which is constructionally simpler (not requiring means for energizing the oil), it is not possible to take advantage in any way of the lubrication circuit to enable it to perform functions other than lubrication. Another disadvantage of this solution is that it does not permit prolonged operation of the pump at relatively high suction pressures. Under such conditions, in fact, the difference in pressure between the outside and the inside of the pump is not sufficient to enable the oil to overcome the resistance that it encounters when it attempts to enter the pump; in this situation there is consequently a risk of seizure.

The presence of an auxiliary lubrication pump not only enables the abovementioned disadvantages to be completely overcome, but also makes it possible to use the oil pressure for controlling devices whose presence is indispensable for correct and reliable installation of the pump in plant which must be exhausted. The most important of these device is the nonreturn device. In the event of the failure of the pump or of a sudden interruption of the supply, there is in fact a risk that first the oil contained in the casing and then the air will be drawn back into the pump by the reduced pressure prevailing there, and will then return into the exhausted installation by way of the suction duct, with serious consequences for the quality of the work being done and the contamination of the installation itself. It is therefore indispensable that the pump should be equipped with an appropriate nonreturn device completely isolating the suction duct from the atmosphere.

Various devices exist which enable this aim to be achieved; these may be divided into two main categories:

(a) devices maintaining the entire pump under vacuum;

(b) devices which maintain the pump at atmospheric pressure.

Those of the first category are the simplest in construction and consist of devices preventing the admission of oil or air into the pump when the latter is at a standstill. These devices can basically be constructed in two different ways, both of which are intended to close the oil admission holes of the pump when the latter stops. The first solution provides for the use of a centrifugal device and is normally adopted in pumps lubricated by suction. The second consists of a calibrated relief valve and is normally used in forced lubrication pumps; when the pump stops, the pressure drops and consequently the relief valve closes the oil supply duct of the pump.

In order to ensure the maintenance of the vacuum inside the pump, both these systems require the use of gaskets - generally of elastomer material - to form seals between the various component parts of the pump; since some of the gaskets intended to ensure dynamic leaktightness during the operation of the pump must ensure perfect static leaktightness (not normally their purpose) in order to keep the pumps under vacuum, there is actually an increased probability that leaks will occur and that tightness cannot be ensured. Finally, the centrifugal device referred to, when it is used, is normally in the form of resilient members in continuous movement and therefore subject to deterioration due to wear and/or fatigue.

It is in addition necessary to take into account two phenomena which limit the efficiency of nonreturn devices which leave the pump under vacuum:

(1) The pump under vacuum remains in communication with the suction line and, if other valves are not provided, also with the installation; since the temperature of the pump is normally higher than that of the suction line and of the installation, the oil vapors contained inside the pump tend to condense on surfaces outside the latter, and consequently also in the suction duct;

(2) When the pump is stopped with the ballast valve (for the elimination of condensable vapors) open, it is not possible to avoid the undesirable return of oil and ballast gas along the suction duct and thus to prevent the pressure in the installation from rising again.

For these reasons the nonreturn devices which leave the pump ensure greater reliability of the system. The gaskets between the various parts of the pump are in fact not required, since the same pressure exists both outside and inside the pump. Furthermore, the device is operated only on the stopping of the pump, thus drastically reducing the number of possible breakdowns due to wear or fatigue. A device of this kind is generally composed of a small piston slidable in a cylinder and received in a closure member floating on it. When the pump is stopped, a valve whose open and closed positions are brought about by the operation of the pump enables fluid at a higher pressure than that inside the pump to enter the cylinder. The piston thus slides in the cylinder and the closure member forms a seal against a seat, which is generally formed near the suction duct. In simpler cases the fluid used is atmospheric air or the air present inside the pump casing.

A centrifugal device connected to the rotor of the pump or a solenoid valve connected to the supply system of the pump, or fed by a generator fastened to the pump shaft, brings the cylinder into communication with the air when the pump is stopped. The pressure of the air then moves the piston and brings the closure member against the seal seat of the suction duct.

With a system of this kind, however, a part of the air will penetrate into the pump during the stroke of the piston, passing through the clearance between the piston and the cylinder, and will have time to pass also into the suction duct before the closure member comes to lie sealingly against its seat. This causes the pressure to rise again in the pump suction line, which is undesirable.

In order to prevent this from happening, systems have been evolved which, because of the pressure produced by an auxiliary oil pump and with the aid of an appropriate circuit, make use of the oil to operate the nonreturn device, thus preventing the air from entering the pump before the suction duct has been completely closed by the closure member.

One example of a system, of this kind makes use of the flow of pressurized oil produced by the oil pump. The oil pressure on the delivery side is kept constant by a breather valve. A second duct, branched off from the supply duct, allows a certain oil flow to pass. Because of its pressure, this oil flow pushes a piston, against the action of a spring constituting the control device, to close the aperture bringing the circuit into communication with the cylinder containing the piston of the nonreturn device. Through the action of the pressure, the oil flow passes on the sides of the piston and, after flowing above it, passes out via a hole formed in its housing and fills an uncovered chamber, from which it overflows to return to the casing. When the pump is stopped, the oil pressure falls abruptly and the spring pushes the piston and brings the cylinder of the nonreturn device into communication with the chamber previously filled with oil. The pressure prevailing in the casing causes the oil in the chamber to pass through the aperture and move the piston of the closure member. In this phase, during the stroke of the piston, it is the oil itself that operates the piston to seal the clearance between it and the cylinder and prevents air from entering. When the oil contained in the chamber has been discharged, the closure member will already have reached its sealing position against the seat of the suction duct and, since there is no longer any oil there to make a seal, the air can enter the pump by travelling along the same path as that previously travelled over by the oil.

This system successfully achieves the aim of controlling the nonreturn device in dependence on the operating conditions of the pump, of causing the control device to act only when the pump is stopped, and preventing oil and air from passing upwards again in the suction duct. However, this solution has some disadvantages:

(a) Constructional disadvantages:

it is necessary to form a suitable seat to receive the piston of the control device and it is also necessary to provide the respective ducts, with the consequent increase in size and additional work;

the auxiliary oil pump must be sufficiently large to provide a far greater flow than that required for the vacuum pump. The piston of the control device is in fact fed in parallel with the pump and is operated by the pressure drop of the oil flow through the clearance between the piston and the seat. This drop is dependent on the clearance existing, which in order not to have an excessive influence on costs must be fairly large. This entails the need for consistent flows in order to achieve the opportune drop. In view of the great variability of operating temperatures and hence of viscosity, such flows make it necessary in practice to adopt oil pumps of the positive displacement type, with their resulting cost and constructional complications;

(b) Functional disadvantages:

the flow of oil, the pressure drop of which operates the control device by collecting in a chamber, is also used as fluid for operating the piston of the nonreturn device. This oil comes from the casing and during its movement is subject to turbulence, so that to a certain extent an emulsion is formed with air. Since however there is a continuous flow, the oil collecting in the chamber does not have time to free the air mixed with it. When the pump is stopped, the oil operating the nonreturn device therefore brings into the interior of the pump a certain amount of air, which causes the pressure to rise again in the exhausted system;

the superabundant flow provided by the oil circulation pump gives rise to the undesirable generation of heat; this necessitates the use of additional heat disipation means in order to ensure the optimum operating temperature of the pump;

since the control device of the nonreturn valve is operated by an oil flow in parallel with that circulating in the vacuum pump lubrication circuit, it is only when the operating pressure has been restored in the lubrication circuit that the control device is moved from the position of rest and the nonreturn valve is opened; this means that it is necessary to wait a not inconsiderable time before the vacuum pump, when it has been put back into operation after a stop, can resume pumping from the suction line.

SUMMARY OF THE INVENTION

The system according to the invention avoids the disadvantages mentioned above.

The lubrication circuit according to the invention is connected to rotary vacuum pumps comprising a hydraulic circuit and a relative pump unit for lubrication and for auxiliary controls, including the isolation of the negative pressure space from the pump upon the stopping of the pump, with the aid of a closure member. This lubrication circuit substantially provides: for the pressure of the fluid present in the pump discharge space to be used for controlling the closure member with the aid of two ducts in series between said discharge space and an operating means for the closure member; and for a control member to be disposed between said ducts, the operation of which member is dependent on the oil pressure produced by the lubrication pump unit and propagated, with complete absence of flow, through a pressure transmission duct so as to reach the control member supervising the operation of the closure member.

More particularly, the ducts between the operating means and the discharge space of the pump have a portion directed upwards and leading into a chamber, the latter being associated with means for filling it with the oil which is to operate in said ducts.

The control member advantageously consists of a diapragm which cooperates with an aperture and which, when subjected to the pump unit pressure transmitted from the pressure transmission duct, interrupts communication between the ducts connected in series; a resilient member opposes the deformation of the diaphragm caused by the oil pressure and makes it possible to reopen communication between the serially connected ducts when the oil pressure falls; the diaphragm prevents direct communication, and therefore prevents a flow of oil between the pump unit and the duct operating the closure member.

The diaphragm is engaged on its perimeter in a cavity formed by coupling together two pump bodies, and divides said cavity into a chamber in communication with the pump unit and a chamber into which lead the two serially connected ducts of the hydraulic circuit intended for the means operating the closure member.

The means for filling the chamber with oil may consist of channels delivering the oil expelled through the discharge valves of the pump and collecting in traps, so that a few moments after starting up, the chamber is already filled with the appropriate amount of oil which had previously passed into the interior of the pump when the latter was stopped.

BRIEF DESCRIPTION OF THE DRAWINGS

The invention will be better understood upon study of the following description and the accompanying drawings, which show one practical non-limitative example of said invention and in which.

DESCRIPTION OF THE PREFERRED EMBODIMENT

Figure 1:
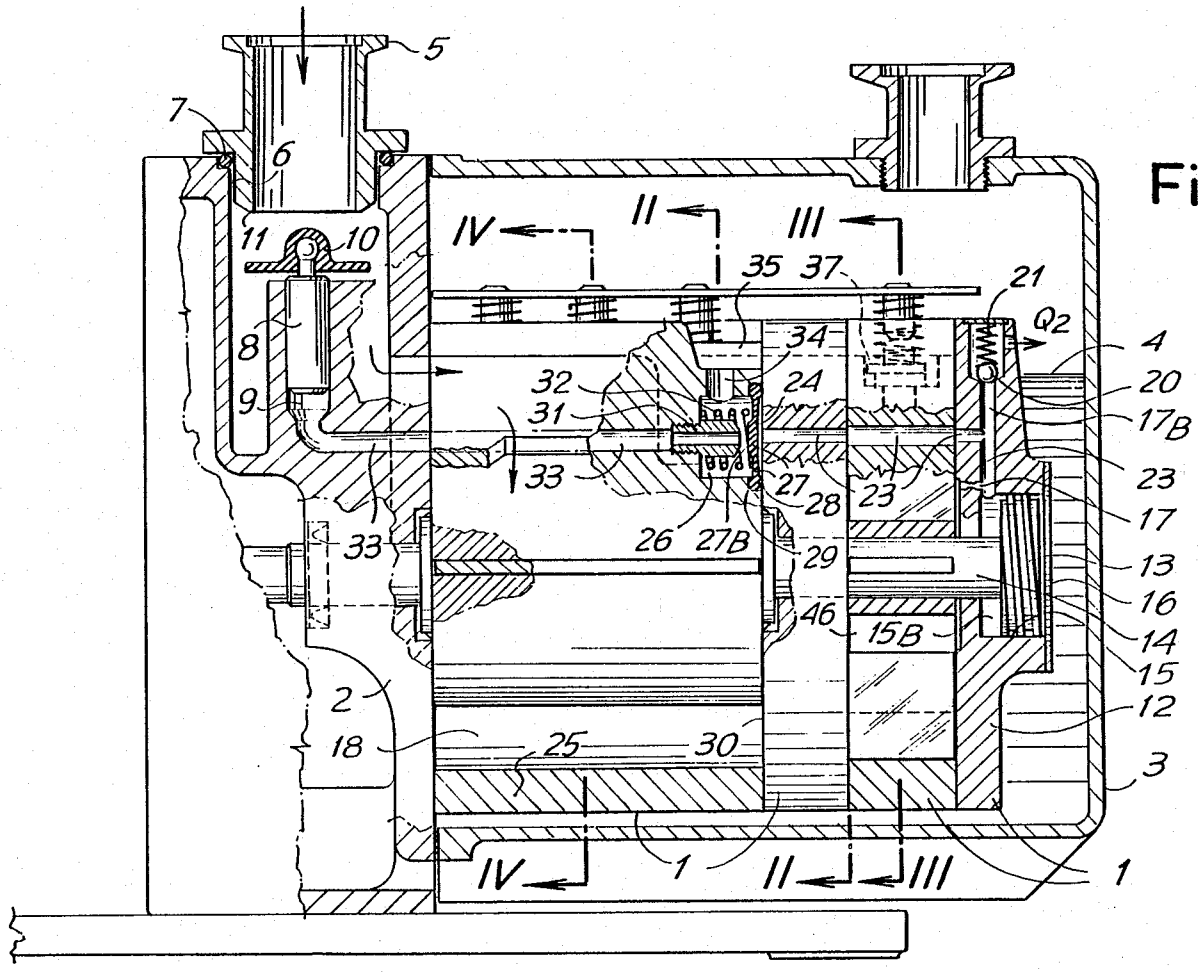
FIG. 1 shows a general longitudinal section in various planes.
Figure 2:
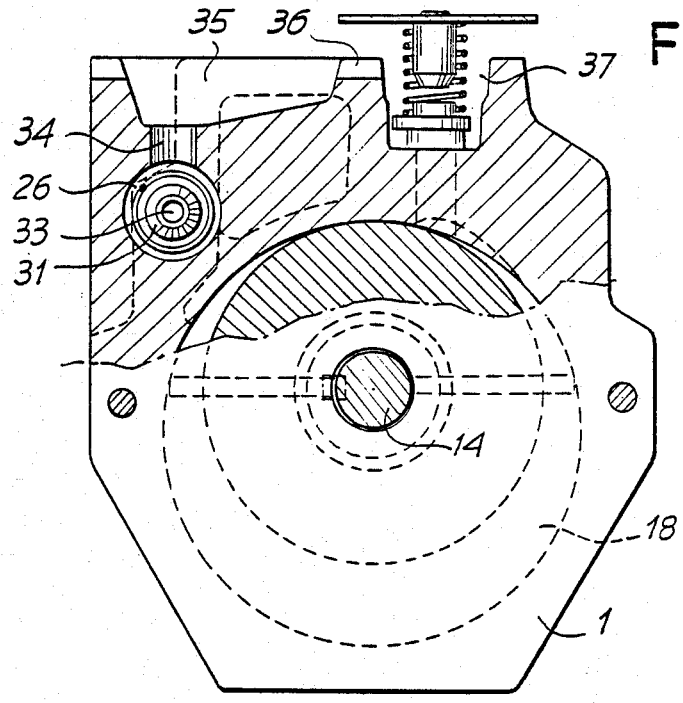
FIGS. 2, 3 and 4 show cross-sections on the lines II—II, III—III and IV—IV in FIG. 1.
Figure 3:
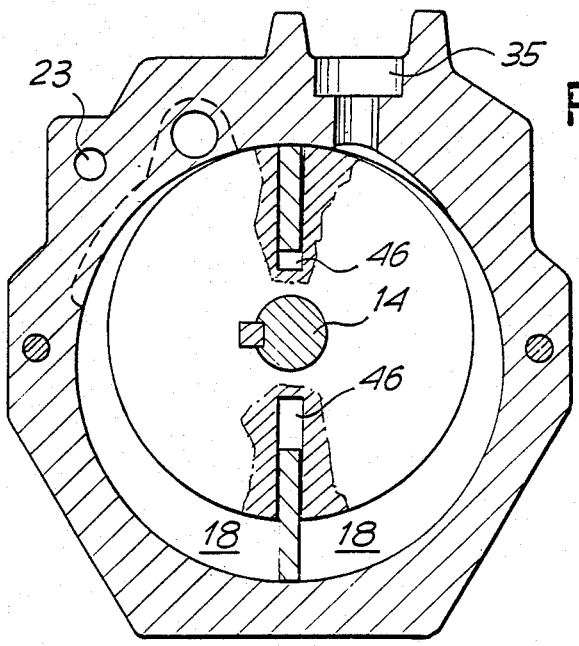
Figure 4:
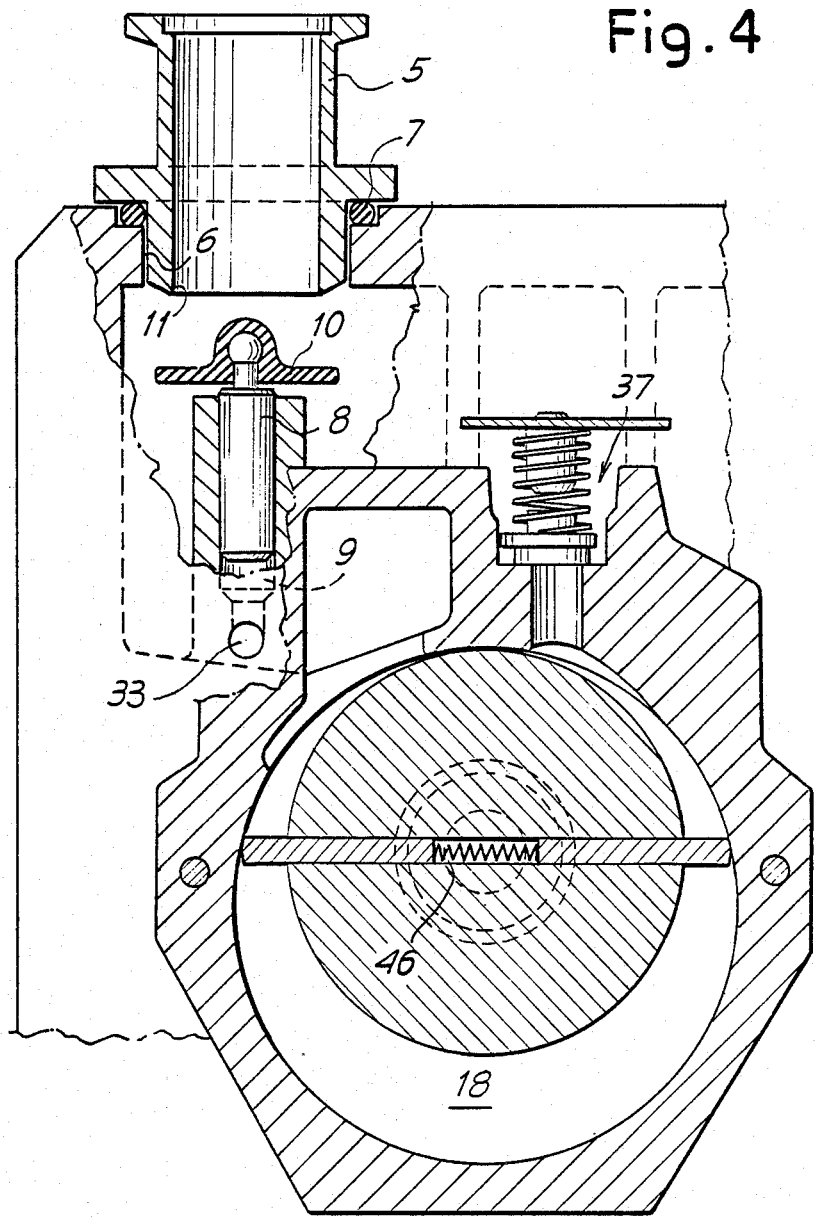

The drawing shows the pump unit 1 mounted on a support 2, which together with the casing 3 forms a tank for the oil 4 surrounding the pump.

On the support 2 is mounted a suction duct 5 received in a seat 6 at which the vacuum-tightness is achieved by means of a gasket 7; a piston 8 is adapted to slide inside a cylinder 9 formed in the support and operates a closure member 10 floating on the piston.

At the moment when the pump is stopped a special device, which will be described below, causes the piston 8 to slide inside the cylinder 9 until the closure member 10 comes to bear against the seal seat 11 formed at the end of the suction duct 5, thus completely isolating the latter from the pump chamber, which at this point can be filled with gas without affecting the vacuum achieved in the space which is to be exhausted.

The action of the piston 8 is achieved with the aid of a special hydraulic circuit, the operation of which is dependent on the conditions of operation and stopping of the pump. The hydraulic circuit is formed entirely inside the component parts of the pump, without it being necessary to make use of external piping and additional connections.

A cylindrical seat 15 provided in the side 12 of the pump receives a special axial pump 13 directly fastened on the rotor shaft 14. The pump 13 is situated at a level such that it is always below the surface of the oil in the tank 4 partly formed by the casing 3. On the side from which the pump 13 draws in oil the closure side face 12 of the cylindrical seat 15 carries a filter 16 preventing the admission of foreign bodies into the lubrication circuit. The oil pump 13 is of such a size as to ensure that under all possible operating conditions of the vacuum pump the flow of oil will be sufficient for correct lubrication and sealing of the clearances between moving parts. This is achieved with the aid of a lubrication duct 17 connecting the delivery chamber 15B of the pump 13 and the chambers 18 of the vacuum pump. A maximum pressure duct 17B branching off from the ducts 17 and/or 23 connects the chamber 15B to a special maximum pressure valve. The latter consists of a ball 19 forming a seal on a conical seat 20, against which it is pressed by a spring 21. The maximum pressure valve is designed to ensure that the oil will penetrate into the vacuum pump in an amount sufficient for all operating conditions of the pump.

A control duct 23 also starts from the delivery chamber 15B of the oil pump 13 and leads into a cylindrical chamber or control space 24 formed in the member coupled to the body 25 of the vacuum pump. On the face 30 of the body 25 a cavity 26 is formed, which is concentric to the chamber 24. The coupling of the two components forms a seat 29, in which the edge 28 of a resilient diaphragm 27, which hermetically separates the spaces 24 and 26, is sealingly secured. By its surface 27B the diaphragm 27 can seal in the closure duct a hole 33 leading into the cavity 26 by way of a nozzle 31 and connecting the cavity 26 to the cylinder 9 of the piston 8. A spring 32 urges the diaphragm 27 away from the nozzle 31.

A duct 34 extends from the top part of the cavity 26 and is in communication with a chamber 35 formed in the top wall of the pump body 25. By way of a channel 36 the chamber 35 is in communication with a trap 37 of the discharge valves of the vacuum pump.

During operation, the suction duct 5 of the pump is connected to the space which is to be exhausted. The pump rotor rotates the oil pump 13 fastened on it. The pump 13 draws in oil from the casing via the filter 16 and pressurizes the oil in the delivery chamber 15B. The oil pump normally used on rotary pumps is of the positive displacement type, either a vane or a gear pump. On the other hand, an important characteristic of the oil pump described here is that, since it is not of the positive displacement type, it does not isolate its suction from the delivery, and therefore, even in the event of a malfunction it still enables the oil from the casing to be returned, during the operation of the vacuum pump, through the duct 17 by the negative pressure prevailing inside the vacuum pump. The oil pump in fact is composed essentially of a helicoidal channel in the rotor 13, of appropriate pitch and section, rotating inside the cylindrical seat 15. Because of its relative velocity in relation to the screw and that of the latter in relation to the cylindrical seat receiving it, the oil contained in the channel is forced towards the chamber 15B, thus drawing an equivalent amount of oil from the casing through the filter 16.

Another important characteristic of this pump is that, since it is housed inside the pump body and is an integral part of the latter, it is beneath the surface of the oil and is therefore always primed.

The oil pressure generated by the pump is kept at a value of 120,000–150,000 pascals by means of the maximum pressure valve 21, which causes the excess oil delivery Q2 to overflow back to the casing. In this way an appropriate amount of oil Q1 can pass through the duct 17 to penetrate into the vacuum pump. At the same time the pressure is propagated, without requiring an additional flow of oil, from the delivery chamber 15B by way of the duct 23 to the chamber 24 and, overcoming the action of the spring 32, causes the diaphragm 27 to bear against the nozzle 31, thus completely isolating the closure duct 33 from the cavity 26, and therefore also completely isolating the suction duct of the vacuum pump from the vacuum pump casing. A particular feature of this arrangement is that the closing of the aperture of the closure duct 33 by means of the diaphragm 27 is achieved solely through the propagation of pressure in the duct 23, entirely without a flow, thus preventing the emulsification of the oil with the air present in the casing. Furthermore, in this way the oil pump is dimensioned for the amount of oil necessary for lubricating the vacuum pump, with advantages in respect of space occupied, a reduction of the energy absorbed by the oil pump, and a reduction of the amount of heat requiring to be dissipated; only the amount of oil strictly needed for the functional requirements of the vacuum pump is circulated at a restricted pressure.

The oil passed into the interior of the pump by way of the duct 17 is expelled together with the gas drawn in by the discharge valves, until the trap 37 is filled. The excess amount of oil then passes through the channel 36 to fill the chamber 35 and overflows from the latter to return to the casing. The oil passes from the chamber 35 by way of the aperture 34 to fill the space 26. The channel 36, the chamber 35, the aperature 34 and the space 26 cooperate to form an oil acculmulation means, whereby an amount of oil discharged from the pump may be accumulated. Any air bubbles, which are due to the fact that the duct 34 and the chamber 35 are situated at a high level in relation to the device, have time to pass readily to the outside before the device is put into action.

At the moment when the pump is stopped, the pressure generated by the oil pump 13 and also prevailing in the duct 23 and the chamber 24 rapidly decreases until it reaches the value of atmospheric pressure. The spring 22 then pushes the diaphragm 27 against the face of the chamber 24, thus bringing the duct 33 into communication with the duct 34. The difference in pressure existing between the two ducts has the effect that the oil present in the chamber 35 is returned to the space 26 and by way of the nozzle 31, which is not yet closed by the diaphragm 27, penetrates into the duct 33 and into the cylinder 9, thus pushing the piston 8 towards the suction duct 5, which is under vacuum.

When the floating closure member 10 comes into contact with the seal seat 11 of the suction duct 5, the space which is to be exhausted is completely isolated from the vacuum pump space. The oil still present in the ducts 33 and 34 is forced by the pressure existing in the casing to pass through the clearance between the piston 8 and the cylinder 9, and passes into the vacuum pump.

When the oil has passed from the chamber 35, the outside air which had forced the oil to pass through can in turn flow into the pump, thus, because of the difference in pressure between the upstream and downstream sides over the entire section of the closure member 10, contributing towards leaktightness at the seat 11. In this way, because of the sealing action of the oil in the clearance between the piston and the cylinder, there is no return of gas into the space being exhausted when the pump is stopped.

At the moment when the pump is started up again, the oil pressure is immediately restored in the ducts 17, 17B and 23, because these ducts were not drained during the stoppage of the vacuum pump. The oil pressure acting on the diaphragm 27 then recloses the duct 33 at the nozzle. The pressure inside the vacuum pump can thus be reduced, and the oil which had previously entered the pump is expelled by the valves 37 and refills the vessel 35 and the chamber 26, thus resetting the device for the next stoppage. The closure member 10, on the other hand, continues to maintain the seal against the seat 11 until the pressure inside the pump has reached a value close to that in the suction duct 5; in view of the ratio normally existing between vacuum pump chambers and the volumetric delivery of the pump, this situation is terminated very quickly; the piston 8 can thus fall again in its seating through its own weight, thus bringing the suction line and the vacuum pump into communication, without however causing any undesirable increase in pressure in the suction duct 5 of the vacuum pump.

Another important characteristic of the device is due to the fact that only slight positive pressures are required for its operation. Consequently, the oil required for lubricating the interior of the vacuum pump can be taken directly from the delivery of the oil pump, the flow being controlled by means of the calibrated aperture 17. The system is such that the oil arrives inside the vacuum pump while still under slight positive pressure and penetrates into the clearance 46 between the vanes and the hub of the rotor. The difference in pressure thus existing between the inside and the outside of the vanes pushes the latter against the surface of the stator and ensures airtightness, thus making resilient components unnecessary.

In this way, apart from the immediate saving in respect of springs and consequent machining, the rotor and the vanes are of simpler construction. Because of the absence of springs, through holes are not needed for mounting the vanes on the rotor. The rotor can thus be in one piece with the mounting for the blades and be produced by milling and grinding.

The arrangement described makes it possible to obviate the disadvantages inherent to traditional pumps having nonreturn devices, at the pressure of which the pumps are left in the atmosphere.

The control device operating the nonreturn device is in fact composed of a simple diaphragm closure member 27, 27B which is inexpensive and of small dimensions, and which can be accommodated between the component parts of the pump.

The use of the oil passing out of the discharge valves to fill the reserve chamber 35, which is necessary for operating the piston 8, permits better degasification of the oil, eliminates excessive dimensions of the auxiliary pump, which has only to ensure the delivery required for the vacuum pump, and consequently reduces the consumption of energy and the amount of heat which has to be extracted from the pump. It is thus possible to use a simple dynamic pump instead of a more expensive and complicated positive displacement pump.

It is obvious that the drawing shows only an example, which is given solely as a practical demonstration of the invention, and that the invention can be varied in respect of shapes and dimensions without thereby departing from the scope of the concept underlying the invention. The use of reference numerals in the accompanying claims is intended to facilitate the reading of the claims in conjunction with the description and the drawing, and does not limit the scope of the protection afforded by the claims.

We claim:

1. A rotary vacuum pump lubrication circuit, comprising: a pump unit including a pump with a pump intake and a pump discharge; a casing cooperating with said pump to define an intake space communicating with a casing intake and said pump intake and a discharge space communicating with a casing discharge and said pump discharge, said discharge space having a lower portion defining an oil space; an oil pump connected to said pump unit, said oil pump having an intake in communication with said oil space and having an oil pump discharge; a lubrication duct connected to said oil pump discharge for supplying oil to said pump; a control space formed in said pumping unit; a control duct connected to said oil pump discharge and connected to said control space; a diaphragm member positioned adjacent said control space, a portion of said diaphragm member being movable between a first position and a second position depending upon oil pressure in said control space; oil accumulation means positioned adjacent said pump discharge, said oil accumulation means for accumulating oil discharged from said pump discharge, said diaphragm separating a portion of said oil accumulation means from said control space; a closure member positioned in said intake space for closing said casing intake; a piston member connected to said closure member; a cylinder positioned adjacent said intake space, said piston being movably positionable within said cylinder; and, a closure duct connected to said cylinder and extending into said oil accumulation means, said closure duct having a nozzle end defining an opening into said oil accumulation means, said diaphragm member closing said nozzle end opening in its first position and allowing communication between said oil accumulation means and said closure duct in said diaphragm second position.

2. A rotary vacuum pump according to claim 1, further comprising: a spring positioned against the portion of said accumulation means and engaging said diaphragm to urge said diaphragm into its second position.

3. A rotary vacuum pump lubrication circuit according to claim 1, wherein: said oil accumulation means includes oil traps positioned adjacent said pump discharge; a chamber positioned adjacent said trap; a channel connected to said trap and said chamber for delivering oil from said trap to said chamber; an oil supply duct extending down from said chamber to an oil accumulation cavity, said diaphragm being positioned adjacent said oil accumulation cavity for movement within said oil accumulation cavity, said oil accumulation cavity, said supply channel and said chamber being filled with oil after start-up of said pump, excess oil spilling over an upper portion of said chamber into said oil space.

4. A rotary vacuum pump lubrication circuit, comprising: a pump unit including a pump housing with a pump having a pump intake and a pump discharge; a casing cooperating with said pump housing to define an intake space communicating with a casing intake and said pump intake and a discharge space communicating with a casing discharge and said pump discharge, said discharge space having a lower portion defining an oil space; an oil pump connected to said pump unit, said oil pump having an intake in communication with said oil space and having a discharge; a dynamic lubrication duct connected to said oil pump discharge for supplying oil to said pump; a substantially static control space defined in said pump housing formed in said pumping unit; a control duct connected to said oil pump discharge and connected to said control space; a diaphragm member positioned adjacent said control space forming a wall of said control space, a portion of said diaphragm member being movable between a first position and a second position depending upon oil pressure in said control space; oil accumulation means positioned adjacent said pump discharge, said oil accumulation means for accumulating oil discharged from said pump discharge, said diaphragm separating a portion of said oil accumulation means from said control space; a closure member positioned in said intake space for closing said casing intake; a piston member connected to said closure member; a cylinder positioned adjacent said intake space, said piston being movable positionable within said cylinder; and, a closure duct connected to said cylinder and extending into said accumulation means, said closure duct having a nozzle end defining an opening into said oil accumulation means, said diaphragm member closing said nozzle end opening in its first position and allowing communication between said oil accumulation means and said closure duct in said diaphragm second position, shut down of said pump and oil pump causing oil pressure in said control space to be lowered thereby causing said diaphragm to move from said diaphragm first position to said diaphragm second position whereby oil in said oil accumulation means passes into said closure duct forcing said piston and closure member into a position in which said closure member closes said casing intake.

* * * * *